United States Patent [19]

Liggett

[11] Patent Number: 4,858,757

[45] Date of Patent: Aug. 22, 1989

[54] COMBINED PACKAGE AND DISH FOR A SOAP BAR PRODUCT

[76] Inventor: James R. Liggett, P.O. Box 768, Bedford, N.Y. 10506

[21] Appl. No.: 208,158

[22] Filed: Jun. 17, 1988

[51] Int. Cl.[4] ..... B65D 65/16; A47K 5/03

[52] U.S. Cl. ..... 206/77.1; 206/45.33; 217/42; 220/DIG. 6; 248/316.8; D6/536

[58] Field of Search ..... D6/536; 206/77.1, 45.33, 206/45.31; 220/DIG. 6; 248/316.8; 217/42

[56] References Cited

U.S. PATENT DOCUMENTS

| | | | |
|---|---|---|---|
| D. 137,908 | 5/1944 | Benoto | D6/536 |
| D. 154,903 | 8/1949 | Caldwell | D6/536 |
| 1,778,370 | 10/1930 | Pardue | 217/42 |
| 2,575,843 | 11/1951 | Semrow | 248/316.8 X |
| 4,406,364 | 9/1983 | Bronander, Jr. | 206/77.1 |

FOREIGN PATENT DOCUMENTS

| | | | |
|---|---|---|---|
| 811767 | 8/1951 | Fed. Rep. of Germany | 217/42 |
| 293064 | 7/1965 | Netherlands | 206/77.1 |

*Primary Examiner*—Bryon P. Gehman

*Attorney, Agent, or Firm*—Wolf, Greenfield & Sacks

[57] ABSTRACT

A combined package and dish structure for a soap bar product. The structure is formed of four side walls connected to form a box open at the top and bottom, the box being dimensioned to permit the soap bar product to be fitted therein. A plurality of dowels extend between two opposed sides of the box near the bottom thereof. When the structure is used as a package, the soap bar product is positioned in the box resting on the dowels, and a covering is provided for the top of the box. The covering may be included as part of a wrapping for the box. When used as a soap dish, the structure is inverted to permit the soap bar product to rest on top of the dowels.

5 Claims, 1 Drawing Sheet

COMBINED PACKAGE AND DISH FOR A SOAP BAR PRODUCT

FIELD OF THE INVENTION

This invention relates to soap bar packaging and more particularly to a structure which is adapted to serve both as a package for a soap bar and as a soap dish.

BACKGROUND OF THE INVENTION

Soap bar products, which include both bar soaps and bar shampoos, are typically packaged in a cardboard box with a paper wrapper, both of which are adapted to be thrown away when the package is opened. Other fancier containers are also available. However, a product does not currently exist which serves as a packaging for the product to, among other things, protect the product during shipment and sale, and is then adapted for use as a soap dish for the product when the package is opened.

It is therefore an object of this invention to provide improved packaging for soap bar products and in particular to provide a structure which is adapted for use to package the product for shipment and sale and for use as a soap dish once the package is opened.

SUMMARY OF THE INVENTION

In accordance with the above, this invention provides a combined package and dish structure for a soap bar product. The structure includes four side walls connected to form a box open at the top and bottom, the box being dimensioned to permit the soap bar product to be fitted therein. A plurality of dowels extend between two opposed sides of the box near the bottom thereof. When the structure is used as a package, the soap bar product is positioned in the box resting on the dowels and means are provided for covering the top of the box. The covering for the top of the box may be included as part of a wrapping for the box. When used as a soap dish, the structure is inverted to permit the soap bar product to rest on top of the dowels. In this position, the soap bar product is substantially on top of and outside the box. The entire structure is preferably formed of wood.

The foregoing and other objects, features and advantages of the invention will be apparent from the following more particular description of a preferred embodiment of the invention as illustrated in the accompanying drawings.

IN THE DRAWINGS

DETAILED DESCRIPTION

Figure 1:
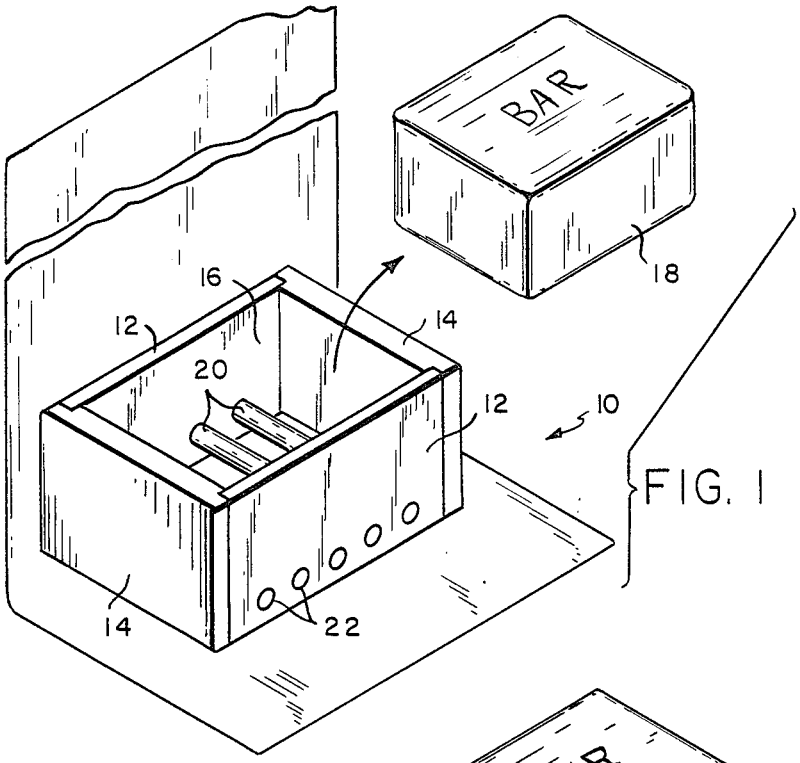
FIG. 1 is an exploded top perspective view of a structure in accordance with the teachings of this invention being used as a package for a soap bar product.

Referring to the figures, the structure 10 of this invention is in the form of a box having two side walls 12 and two end walls 14. The joints between the side walls 12 and end walls 14 may be fitted as shown, or may be mitred, tongue in groove, butted, or other standard construction for such joints. The joints may be held together by gluing, by nails, staples, friction or other suitable means, or by a combination of two or more of the above. The height and length of each of the side walls 12 and each of the end walls 14 are such that, when the walls are secured together to form the box 10, the interior cavity 16 is dimensioned to hold soap bar product 18. As previously indicated, soap bar product 18 may either be a soap bar or a shampoo bar.

A plurality of spaced dowels 20 extend between side walls 12 near the bottom of cavity 16. Dowels 20 are preferably evenly spaced. For the embodiment shown, a plurality of holes 22 are formed in each side wall 12 at the locations where the dowels are to extend from the side walls, and the ends of the dowels extend through the holes 22, providing a pressure fit for the dowels. By suitably dimensioning the dowels and the holes 22, and by mounting the dowels to one of the side walls before the box 10 is fully assembled, it is possible to hold the dowels in place by friction alone without glue. With other constructions, it may be necessary to glue, nail, or otherwise secure the dowels in place.

The side walls 12, end walls 14 and dowels 20 may be formed of the same material, such as for example a wood or plastic, or may be formed of different materials. For the preferred embodiment, all the components of box 10 are formed of wood.

When used as a package, bar 18 is fitted in cavity 16 of box 10 and a wrapping material, such as a shrink-wrap plastic sheet 24, is sealed over the box 10 to hold the soap bar product 18 in place. Printing and any appropriate logos identifying the product may be imprinted on box 10, may be embossed, wood burned, imprinted or the like on wrapping 24, or a paper strip (not shown) containing printed matter may be placed over a portion of box 10, for example the top thereof, before wrapping 24 is applied.

While it is preferred that wrapping 24 cover the entire box 10, in some applications, for aesthetic or other reasons, a wrapping may be applied only to cover the top of box 14 being taped or otherwise secured to the box, or a wrapping may be applied only around the top, bottom and sides 12 (or ends 14) of box 10, and not around ends 14 (or sides 12). Still another option is for bar 18 to be individually wrapped and the wrapped bar to be fitted into box 10 and held in the box in a suitable manner for shipment.

Figure 2:
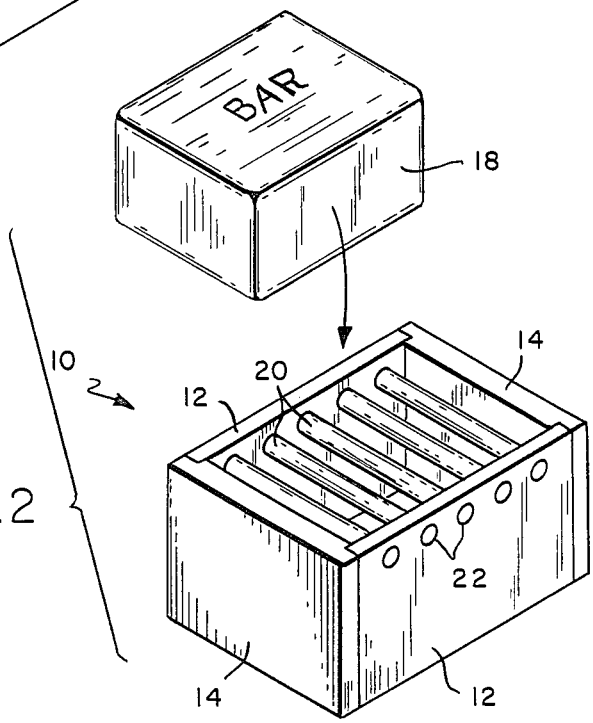
FIG. 2 is an exploded top perspective view of a structure of this invention being used as a soap dish.

Referring to FIG. 2, when wrapping 24 and/or any other wrapping provided has been removed, box 10 may be inverted to the position shown in FIG. 2 so that soap bar product 18 may rest on top of dowels 20, and within the small portion of the side walls 12 and end walls 14 extending beyond the dowels, permitting the box to serve as a soap dish or rack for the soap bar product to dry properly after usage. The box 10 may be disposed of when the soap bar product 18 has been used up, or may be retained for continued use.

While the invention has been described above with reference to a preferred embodiment, the foregoing and other changes in form and detail may be made therein by one skilled in the art without departing from the spirit and scope of the invention.

What is claimed is:

1. A combined package and dish structure for a soap bar product comprising:

four side walls connected to form a box open at the top and bottom, said box being dimensioned to permit the soap bar product to fit therein; and a plurality of dowels extending between two opposed side walls of the box slightly spaced from the bottom thereof, a small portion of each of said pour side walls extending below said dowels;

the soap bar product being positioned in the box resting on the dowels to form a package, and said box being invertable so that the soap bar product can rest on the said dowels within said four side walls and outside said box when used as a soap dish.

2. A structure as claimed in claim 1 and including means for covering the top of the box.

3. A structure as claimed in claim 2 wherein said means for covering is included as part of a means for wrapping the box around the top, bottom and at least two opposed walls thereof.

4. A structure as claimed in claim 3 wherein said means for wrapping completely encloses said box.

5. A structure as claimed in claim 1 wherein said box and dowels are formed of wood.

* * * * *